US011448378B2

(12) United States Patent
Iwasaki

(10) Patent No.: US 11,448,378 B2
(45) Date of Patent: Sep. 20, 2022

(54) VEHICLE LAMP USING COMPOUND OPTICAL LENS

(71) Applicant: Ichikoh Industries, Ltd., Isehara (JP)

(72) Inventor: Kazunori Iwasaki, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/271,771

(22) PCT Filed: Aug. 30, 2019

(86) PCT No.: PCT/JP2019/034304
§ 371 (c)(1),
(2) Date: Feb. 26, 2021

(87) PCT Pub. No.: WO2020/045674
PCT Pub. Date: Mar. 5, 2020

(65) Prior Publication Data

US 2021/0325017 A1 Oct. 21, 2021

(30) Foreign Application Priority Data

Aug. 31, 2018 (JP) ..... JP2018-163030
Dec. 4, 2018 (JP) ..... JP2018-227201

(51) Int. Cl.
*F21S 41/29* (2018.01)
*F21S 41/32* (2018.01)
(Continued)

(52) U.S. Cl.
CPC ..... *F21S 41/295* (2018.01); *F21S 41/143* (2018.01); *F21S 41/27* (2018.01); *F21S 41/322* (2018.01); *F21S 41/43* (2018.01)

(58) Field of Classification Search
CPC ..... F21S 41/27; F21S 41/295; F21S 41/322; F21S 41/143
See application file for complete search history.

(56) References Cited

U.S. PATENT DOCUMENTS 5,499,166 A * 3/1996 Kato ..... F21S 41/27 362/559
2004/0156209 A1* 8/2004 Ishida ..... F21S 41/663 257/E33.059
(Continued)

FOREIGN PATENT DOCUMENTS

FR 3 010 772 A1 3/2015
JP 2004-241349 A 8/2004
(Continued)

OTHER PUBLICATIONS

International Search Report dated Nov. 19, 2019 in PCT/JP2019/034304 filed Aug. 30, 2019, 2 pages.

*Primary Examiner* — Rajarshi Chakraborty
*Assistant Examiner* — Michael Chiang
(74) *Attorney, Agent, or Firm* — Oblon, McClelland, Maier & Neustadt, L.L.P.

(57) ABSTRACT

A vehicle lamp includes a light source and a compound optical lens that emits light forward. The compound optical lens has an incidence surface, an emission surface, and a shade part. The emission surface emits the light received by the incidence surface forward. The shade part is disposed between the incidence surface and the emission surface. The compound optical lens has first and second reflector surfaces. The first reflector surface reflects light forming a first light distribution pattern toward the emission surface. The second reflector surface reflects light forming a condensed-light distribution pattern toward the emission surface. The width of the first reflector surface is larger than the width of the second reflector surface in a vehicle width direction at a position where the first reflector surface and the second reflector surface are adjacent to each other.

11 Claims, 12 Drawing Sheets

(51) Int. Cl.

| | |
|---|---|
| ***F21S 41/143*** | (2018.01) |
| ***F21S 41/43*** | (2018.01) |
| ***F21S 41/27*** | (2018.01) |

(56) References Cited

U.S. PATENT DOCUMENTS

| | | | | |
|---|---|---|---|---|
| 2014/0085919 | A1* | 3/2014 | Tsai | F21S 41/322<br>362/522 |
| 2017/0067610 | A1* | 3/2017 | Lo | F21S 41/143 |
| 2018/0299090 | A1* | 10/2018 | Owada | F21S 41/27 |

FOREIGN PATENT DOCUMENTS

| | | | |
|---|---|---|---|
| JP | 2014-60041 | A | 4/2014 |
| JP | 2014-67715 | A | 4/2014 |

* cited by examiner

31

VEHICLE LAMP USING COMPOUND OPTICAL LENS

TECHNICAL FIELD

The present invention relates to a vehicle lamp.

BACKGROUND ART

Patent Literature 1 discloses a vehicle lamp in which a low-beam light distribution pattern is formed by multiple light source units having different light distribution characteristics using compound optical lenses composed of shades and reflectors integrated with the lenses.

CITATION LIST

Patent Literature

PTL 1: Japanese Unexamined Patent Publication No. 2004-241349

SUMMARY OF THE INVENTION

Problems to be Solved by the Invention

There is a problem in that as the number of light source units increases, the vehicle lamps become larger.

Therefore, an object of the disclosure is to provide a vehicle lamp using a compound optical lens that enables downsizing.

Means for Solving the Problem

According to one aspect of the present disclosure, a vehicle lamp is provided with a light source and a compound optical lens that emits light of the light source toward the front side; the compound optical lens is an integrally molded lens having an incidence surface, an emission surface, and a shade part, the incidence surface receiving light, the emission surface emitting the light from the incidence surface toward the front side, the shade part being formed between the incidence surface and the emission surface; the compound optical lens includes a first reflector surface that disposes above a top line of the shade part on the upper side of the incidence surface and reflects a light forming a first light distribution pattern toward the emission surface, and a second reflector surface that disposes below the top line on the lower side of the incidence surface and reflects a light forming a condensed-light distribution pattern toward the emission surface; the width of the first reflector surface is larger in a width of vehicle width direction at a position where the first reflector surface and the second reflector surface are adjacent to each other.

Effect of the Invention

According to the disclosure, a vehicle lamp using a compound optical lens that enables downsizing can be obtained.

MODE FOR CARRYING OUT THE INVENTION

Embodiments will now be described with reference to the accompanying drawings. Note that the same numbers or reference signs denote the same elements throughout the description of the embodiments.

In the embodiments and drawings, the terms "front" and "rear" respectively refer to a "forward traveling direction" and a "backward traveling direction", and the terms "top", "bottom", "left", and "right" refer to directions as seen from the driver of a vehicle 102, unless otherwise specified.

Note that the terms "top" and "bottom" also respectively refer to the "top" and the "bottom" in the vertical direction, and the terms "left" and "right" also respectively refer to the "left" and "right" in the horizontal direction.

First Embodiment

Figure 1:
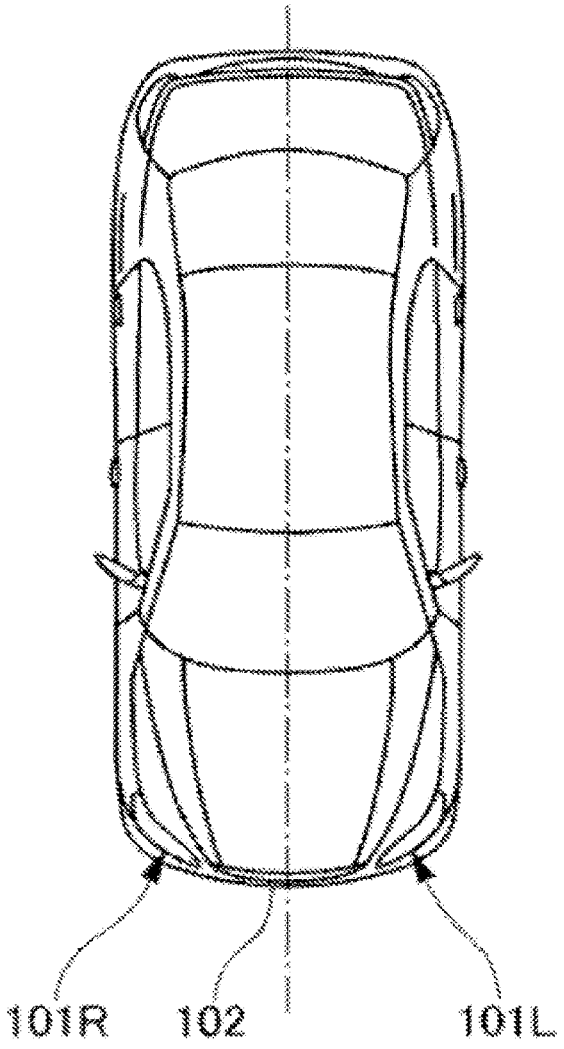
FIG. 1 is a plan view of a vehicle including vehicle lamps of a first embodiment.

FIG. 1 is a plan view of a vehicle 102 including vehicle lamps of a first embodiment. As illustrated in FIG. 1, the vehicle lamps of the first embodiment are vehicle headlights (101L, 101R) disposed on the front side of the vehicle 102, and, hereinafter, are simply referred to as vehicle lamps.

A vehicle lamp of the present embodiment includes a housing (not illustrated) opened on the front side of the vehicle and an outer lens (not illustrated) attached to the housing so as to cover the opening. The vehicle lamp further includes a lamp unit 1 (see FIG. 2), etc., disposed in a lighting room composed of the housing and the outer lens.

Figure 2:
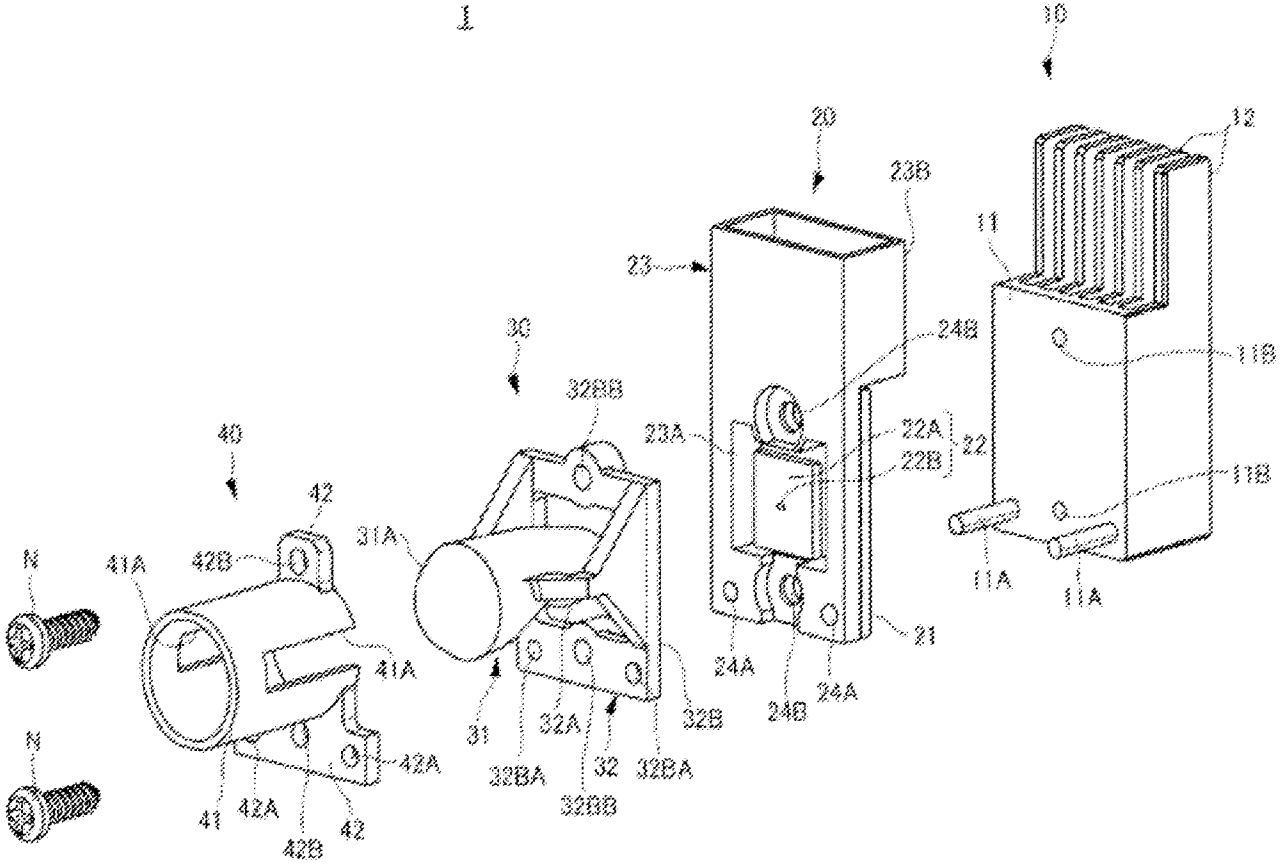
FIG. 2 is an exploded perspective view of a lamp unit of the first embodiment.

FIG. 2 is an exploded perspective view of a lamp unit 1 of the first embodiment. As illustrated in FIG. 2, the lamp unit 1 includes a heatsink 10, a light source device 20 attached to the heatsink 10, an optical control member 30 disposed on the light source device 20, and a cover 40 that covers a portion of the optical control member 30.

(Heatsink 10)

The heatsink 10 includes a base part 11 on which the light source device 20 is disposed; multiple heat radiating fins 12 disposed on the rear side of the base part 11 and arranged along the vehicle width direction; and two positioning pins 11A disposed on one side of the base part 11 in the vertical direction (bottom in FIG. 2), protruding toward the front side, and separated in the vehicle width direction.

Two screw engagement holes 11B are formed in the base part 11 in the central area in the vehicle width direction and at positions separated in the vertical direction. Two screws N are screwed and fixed to the two screw engagement holes 11B so as to fasten together the light source device 20, the optical control member 30, and the cover 40, as described below.

The heat radiating fins 12 extends vertically from the base part 11 to a second side (upper side in FIG. 2). The portion that extends vertically from the base part 11 (upper portion in FIG. 2) has a shape in which the base part 11 is recessed toward the rear side so as to house a connector connecting portion 23B of the light source device 20 as described below.

In the present embodiment, the heatsink 10 is a heatsink 10 made of die-cast aluminum, but the heatsink 10 is not limited to this, and may be formed by using a metal or resin having high thermal conductivity.

(Light Source Device 20)

The light source device 20 includes a heat transfer member 21; a light source 22 disposed on the heat transfer member 21; and a connecting part 23 disposed on the heat transfer member 21 and having an opening 23A and a connector connecting portion 23B. The opening 23A is disposed at a position corresponding to the light source 22, and the connector connecting portion 23B is connected to an external connector.

Note that the connector connecting portion 23B is positioned on the second side (upper side in FIG. 2) in the vertical direction of the heat transfer member 21 such that a portion of the connector connecting portion 23B protrudes to the rear side of the heat transfer member 21. As mentioned above, the protruding portion is positioned in a recess in the heat radiating fins 12 toward the rear side.

In the present embodiment, the heat transfer member 21 is composed of an aluminum plate having a larger outer shape than that of the light source 22. However, the heat transfer member 21 may be composed of any material other than aluminum such as a metal or resin aluminum having high thermal conductivity. The heat transfer member 21 serves to increase the cooling efficiency of the light source 22 by efficiently transferring heat to the heatsink 10 while rapidly diffusing the heat generated at the light source 22 over a wide range.

The light source 22 includes a substrate 22A having a light emitting region 22B that transmits light, and a light emitting chip (not illustrated) that is disposed on the back side of the substrate 22A and emits light for lighting the light emitting region 22B. In the embodiment, the light source 22 is a laser diode light source (LD light source) using a laser diode chip (LD chip) as the light emitting chip, but alternatively a light-emitting-diode light source (LED light source) using an LED chip as the light emitting chip may be used.

Note that the light source 22 (light emitting chip) of the present embodiment has a lumbar cyan distribution or a similar distribution having a flat light emitting portion.

However, since it is easier to downsize a light source 22 that is an LD light source than one that is an LED light source, it is preferable that the light source 22 be an LD light source.

The connecting part 23 is a member formed by, for example, insert-molding using an electrically insulating resin having excellent heat resistance so as to internally accommodate electrical wiring (not illustrated) for electrically connecting the light source 22 and the external connector. One end of the electrical wiring (not illustrated) is led out to the opening 23A to establish an electrical connection with the light source 22, and the other end of the electrical wiring (not illustrated) is led out into the connector connecting portion 23B to establish an electrical connection with an external connector.

The light source device 20 includes two positioning holes 24A through which the two positioning pins 11A disposed on the base part 11 are passed, and two screw holes 24B disposed at positions corresponding to the screw engagement holes 11B formed in the base part 11. The light source device 20 can be fixed to the heatsink 10 by screws N while being positioned by the positioning pins 11A.

(Optical Control Member 30)

The optical control member 30 includes a compound optical lens 31 that emits the light from the light source device 20 toward the front side, and a fixing part 32 for arranging the compound optical lens 31 on the light source device 20 and fixing the compound optical lens 31 to the heatsink 10 together with the light source device 20. In the optical control member 30, the compound optical lens 31 and the fixing part 32 are integrally formed of a transparent resin (for example, acrylic resins and polycarbonate resins).

The fixing part 32 includes a pair of leg portions 32A extending toward the rear side from the left and right side surfaces (left and right side surfaces on the front side of the top line 31CA of a shade part 31C described below) that do not affect the optical control of the compound optical lens 31, and a base portion 32B for fixing provided so as to be connected to the pair of leg portions 32A.

The base portion 32B includes a pair of positioning holes 32BA through which the pair of positioning pins 11A disposed on the base part 11 are passed, and a pair of screw holes 32BB disposed at positions corresponding to the screw engagement holes 11B formed in the base part 11. The base portion 32B is fixed together with the light source device 20 to the heatsink 10 by the screws N while being positioned by the positioning pins 11A.

By disposing the base portion 32B of the optical control member 30 on the connecting part 23 of the light source device 20, contact with the heat transfer member 21 of the light source device 20 is avoided. The connecting part 23 functions as a heat insulator disposed between the optical control member 30 and the heat transfer member 21. In this way, an acrylic resin having low heat resistance (for example, a heat resistant temperature of approximately 100° C.) can be used for the optical control member 30 with no problem.

(Cover 40)

The cover 40 includes substantially cylindrical covering part 41 and flange parts 42. The covering part 41 is opened so as not to block an emission surface 31A that emits the light of the compound optical lens 31 and an incidence surface 31B (see FIGS. 8 and 10 described below) on which the light is incident, and covers the side surface of the compound optical lens 31. The flange parts 42 are positioned behind the covering part 41 so as to protrude outward from the covering part 41 and fixes the cover 40 to the heatsink 10 together with the optical control member 30 and the light source device 20.

Note that the covering part 41 has a pair of notches 41A, separated in the vehicle width direction, at the front edge so that the pair of leg portions 32A of the fixing part 32 of the compound optical lens 31 can be inserted from the rear edge side.

A pair of flange parts 42 are disposed apart from each other, on one side in the vertical direction (lower side in FIG. 2) and on another side in the vertical direction (upper side in FIG. 2) with reference to the portions of the pair of notches 41A, to enable the insertion of the leg portions 32A into the notches 41A.

The flange parts 42 have a pair of positioning holes 42A through which the pair of positioning pins 11A disposed on the base part 11 pass, on the flange part 42 on the one side in the vertical direction (lower side in FIG. 2), and a pair of screw holes 42B, one of which is formed on the one side in the vertical direction (lower side in FIG. 2) and another one of which is formed on the other side in the vertical direction (upper side in FIG. 2), at positions corresponding to the screw engagement holes 11B disposed on the base part 11. The flange parts 42 are fixed to the heatsink 10 together with the optical control member 30 and the light source device 20 by the screws N while being positioned with the positioning pins 11A.

Note that the cover 40 is for suppressing light leakage from a position other than the emission surface 31A of the compound optical lens 31, and in the present embodiment, the cover 40 is formed of an opaque resin that does not transmit light.

However, the cover 40 may be formed of a transparent resin that allows light to pass through, and may have a colored layer that suppresses light transmission on the surface. Alternatively, the cover 40 may be omitted, and aluminum vapor deposition or the like may be performed on a portion of the compound optical lens 31 other than the incidence surface 31B and the emission surface 31A to provide the same function as the cover 40.

Figure 3:
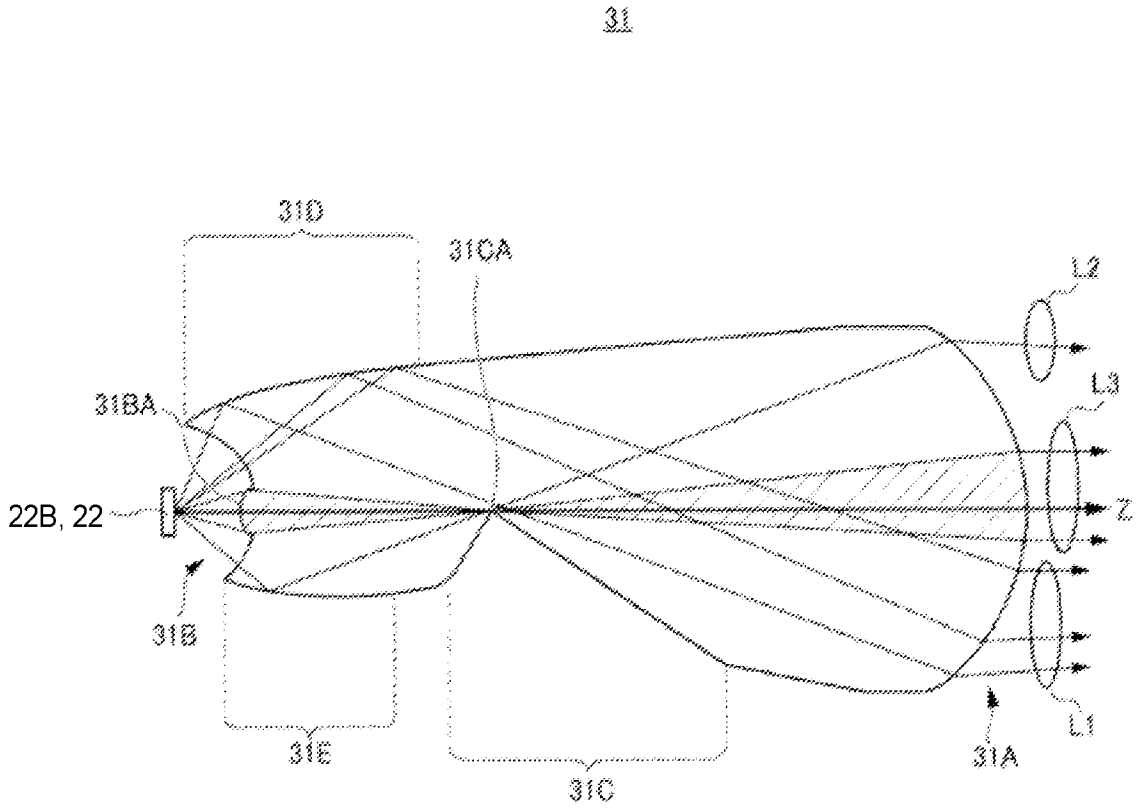
FIG. 3 is a cross-sectional view of a compound optical lens of the first embodiment.

The compound optical lens 31 will now be described in detail with reference to FIGS. 3 and 4. FIG. 3 is a cross-sectional view of the compound optical lens 31 and is a cross-sectional view from the side surface taken along the lens optical axis Z in the vertical direction.

Note that FIG. 3 also schematically illustrates the light emitting region 22B of the light source 22. FIG. 4 is a perspective view of the compound optical lens 31, in which the incidence surface 31B side of the compound optical lens 31 is visible.

Figure 4:
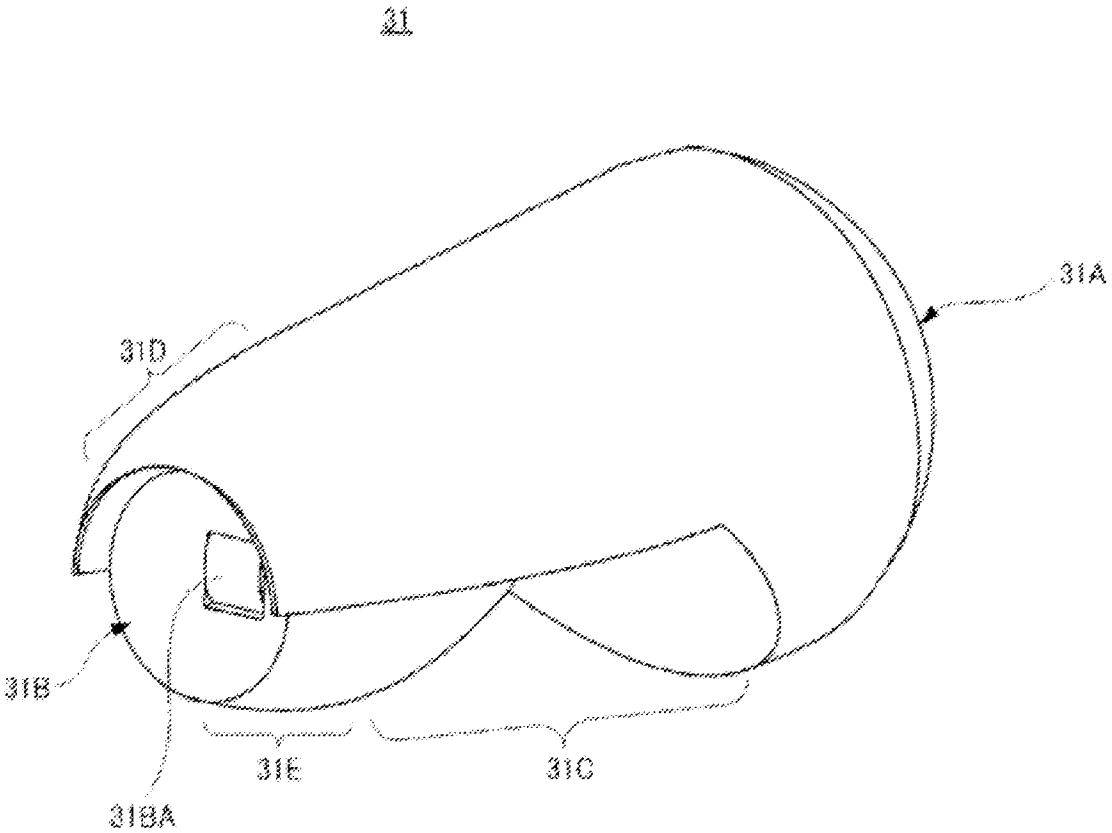
FIG. 4 is a perspective view of a compound optical lens of the first embodiment.

As illustrated in FIGS. 3 and 4, the compound optical lens 31 is an integrally molded lens having an incidence surface 31B, an emission surface 31A, and a shade part 31C. The incidence surface 31B receives light from the light source 22 (see FIG. 3). The emission surface 31A emits the light from the incidence surface 31B toward the front side and is a smoothly curved surface, without fine asperities, protruding toward the front side. The shade part 31C is formed between the incidence surface 31B and the emission surface 31A.

Note that, as in the present embodiment, by not forming asperities on the emission surface 31A, such as in prisms, it is possible to suppress the occurrence of light streaks and unevenness, and form a low-beam light distribution pattern that does not cause discomfort to the driver.

The shade part 31C is formed so as to form a substantially triangular recess on the inner side of the compound optical lens 31 from the lower side in the vertical direction at a position between the incidence surface 31B and the emission surface 31A of the compound optical lens 31. The position of the apex of the triangular recess is set to be the top line 31CA that matches the shape of the cut-off line.

The top line 31CA is formed so that the portion forming the upper side of the oblique cut-off line is positioned at the rear focal point or in the vicinity of the rear focal point of the emission surface 31A.

The compound optical lens 31 has a semi-dome-shaped first reflector surface 31D having a free curved surface and a semi-dome-shaped second reflector surface 31E having a free curved surface. The first reflector surface 31D is formed on the upper side (upper side in the vertical direction) of the incidence surface 31B side of the top line 31CA of the shade part 31C, and reflects, toward the emission surface 31A, a light beam L1 that forms a first light distribution pattern of the low-beam light distribution pattern incident from the incidence surface 31B. The second reflector surface 31E is formed on the lower side (lower side in the vertical direction) of the incidence surface 31B side of the top line 31CA and reflects, toward the emission surface 31A, a light beam L2 that forms a condensed-light distribution pattern of the low-beam light distribution pattern incident from the incidence surface 31B.

Note that, in the present embodiment, the first light distribution pattern is a diffused-light distribution pattern of the low-beam light distribution pattern, and therefore hereinafter may be referred to as the first diffused-light distribution pattern.

As apparent from FIG. 4, the width of the first reflector surface 31D is larger than the width of the second reflector surface 31E in the vehicle width direction at the position where the first reflector surface 31D and the second reflector surface 31E are adjacent to each other so that the first diffused-light distribution pattern of the low-beam light distribution pattern can be satisfactorily formed.

Note that the front focal points of the basic optical paths of the first reflector surface 31D and the second reflector surface 31E substantially coincide with the rear focal point of the emission surface 31A.

In this way, in the present embodiment, since the first diffused-light distribution pattern and the condensed-light distribution pattern of the low-beam light distribution pattern can be formed with one compound optical lens 31, many light units 1 for forming the low-beam light distribution pattern is not needed, and the vehicle lamp can be downsized.

In the present embodiment, the incidence surface 31B is a concave surface of which the overall shape is recessed toward the inner side of the compound optical lens 31. The incidence surface 31B has a convex surface 31BA that protrudes outward from the compound optical lens 31 and receives a light beam L3 forming a second light distribution pattern of the low-beam light distribution pattern in the central area.

Note that, in the present embodiment, the second light distribution pattern is a medium-diffused-light distribution pattern of the low-beam light distribution pattern that is smaller than the first diffused-light distribution pattern of the low-beam light distribution pattern, and therefore hereinafter may be referred to as the second diffused-light distribution pattern.

As illustrated in FIG. 4, the convex surface 31BA has a substantially rectangular outer shape (square shape) and is formed so that the front focal point is located on the top line 31CA or in the vicinity of the top line 31CA, as illustrated in FIG. 3.

Since the light source 22 is positioned behind the convex surface 31BA so that the center of the convex surface 31BA and the light emission center of the light source 22 substantially coincide with each other when viewed in the vehicle width direction and the vertical direction, the light received by the convex surface 31BA is gradually condensed toward the top line 31CA and then gradually spreads from the front focal point toward the emission surface 31A, without great refraction, so as to form a satisfactory medium-diffused-light distribution pattern.

Note that, to be more precise, the convex surface 31BA is designed to collect light in the vertical direction, but is designed to diffuse or spread in the horizontal direction.

In this way, in the present embodiment, the second diffused light distribution pattern, which is a medium level diffused-light distribution pattern (medium-diffused-light distribution pattern), multiplexed with the condensed-light distribution pattern and the first diffused light distribution pattern, is also formed. Therefore, the luminous intensity distribution of the low-beam light distribution pattern can be more satisfactory.

Since the incidence surface 31B on the outer side of the convex surface 31BA has a shape that extends to the rear side, and the entire shape of the incidence surface 31B has a concave shape that is recessed toward the inner side of the compound optical lens 31, the light emitted from the light source 22 toward the front side can be incident on the compound optical lens 31 without loss, in consideration of the spread of the light.

Note that the rear focal point of the overall shape of the incidence surface 31B, which is the concave surface recessed toward the inner side of the compound optical lens 31, substantially coincides with the rear focal points of the first reflector surface 31D and the second reflector surface 31E, and these rear focal points substantially coincide with the light emission center of the light source 22.

If the contrast is too clear at the cut-off line of the low-beam light distribution pattern, visibility is impaired. Therefore, in the present embodiment, as illustrated in FIG. 3, the emission surface 31A is formed to have a shape that causes a portion of the light beam L1 forming the first diffused-light distribution pattern (a lower portion in the present embodiment) to be incident above the cut-off line of the condensed-light distribution pattern and the second diffused-light distribution pattern.

Specifically, the curvature of the lower side of the emission surface 31A is smoothly adjusted so that the light is emitted upward by approximately 0.2 to 0.5 degrees relative to the lens optical axis Z.

Therefore, light is also incident on above the cut-off line of the condensed-light distribution pattern and the second diffused-light distribution pattern, and the sharpness of the cut-off line is appropriately lowered, so that the visibility can be improved.

As described above, according to the present embodiment, the light source 22 is disposed so as to emit light toward the front side, and the compound optical lens 31 utilizes the spread of the light, forms a diffused-light distribution pattern (first diffused-light distribution pattern) of the largest low-beam light distribution pattern with the light spreading to the upper side, forms a condensed-light distribution pattern of the low-beam light distribution pattern with the light spreading to the lower side, and forms a middle-diffused-light distribution pattern (second diffused-light distribution pattern) of the low-beam light distribution pattern with the light in the central area; therefore a satisfactory low-beam light distribution pattern can be formed without using many lamp units 1, and the vehicle lamp can be downsized.

Note that, in the vicinity of the upper edge of the cut-off line, the spectroscopic light of the condensed-light distribution pattern having a slight yellow tint and the spectroscopic light of the first diffused-light distribution pattern having a bluish tint are multiplexed so that the spectral color can be relaxed.

Second Embodiment

A vehicle lamp of a second embodiment will now be described with reference to FIGS. 5 to 7. The overall configuration of the lamp unit 1 is also the same in the second embodiment, and the only difference from the first embodiment is the compound optical lens 31. Therefore, the main differences will be described below, and description of the same points may be omitted.

Figure 5:
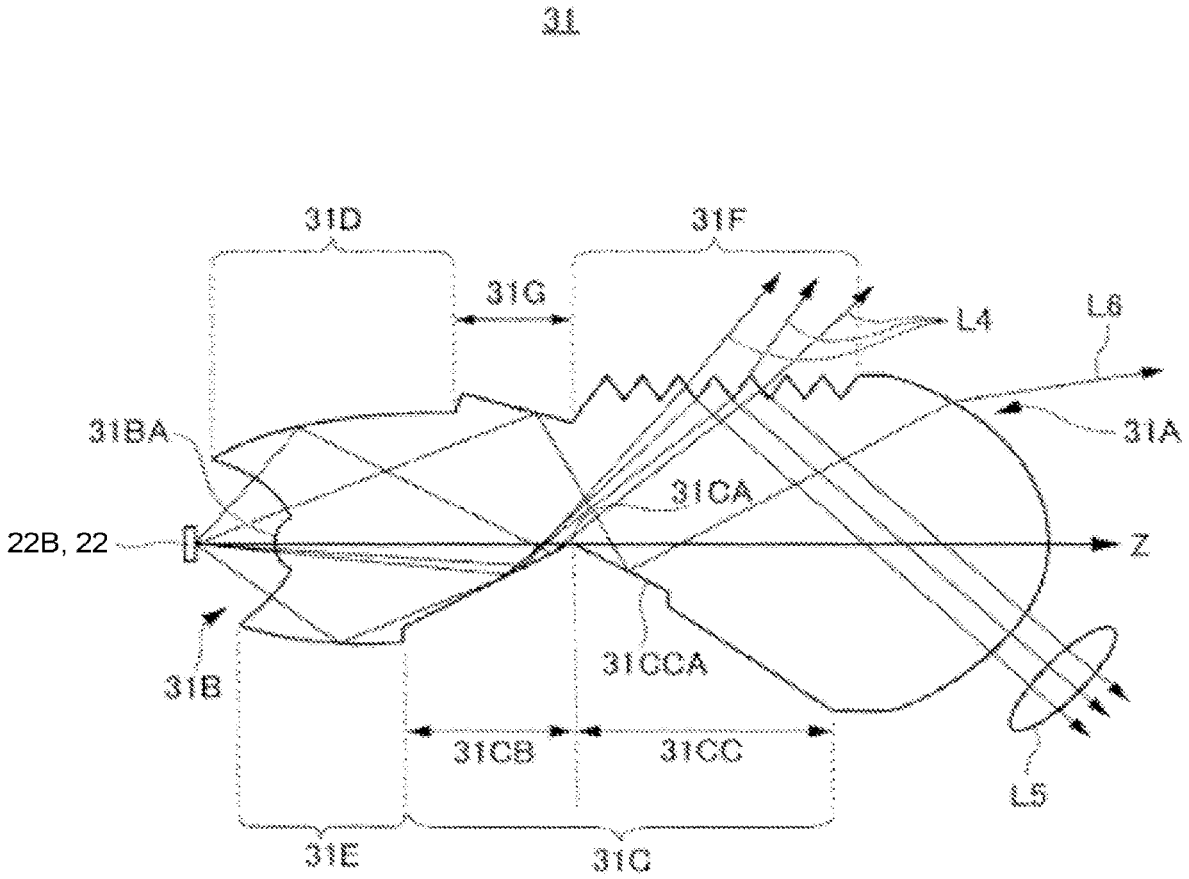
FIG. 5 is a cross-sectional view of a compound optical lens of a second embodiment.

FIG. 5 is a cross-sectional view of the compound optical lens 31 of the present embodiment and is a cross-sectional view from the side surface taken along the lens optical axis Z in the vertical direction. Note that FIG. 5 also schematically illustrates the light emitting region 22B of the light source 22. FIG. 6 is a perspective view of the compound optical lens 31 in which that the emission surface 31A side of the present embodiment is visible. FIG. 7 is a perspective view of the compound optical lens 31 in which the incidence surface 31B side of the present embodiment is visible.

As illustrated in FIG. 5, similar to the compound optical lens 31 of the first embodiment, the compound optical lens 31 of the present embodiment is an integrally molded lens having an incidence surface 31B, an emission surface 31A, and a shade part 31C. The incidence surface 31B receives light from the light source 22. The emission surface 31A emits the light from the incidence surface 31B toward the front side. The shade part 31C is formed between the incidence surface 31B and the emission surface 31A.

The shade part 31C is also formed so as to form a substantially triangular recess on the inner side of the compound optical lens 31 from the lower side in the vertical direction at a position between the incidence surface 31B and the emission surface 31A of the compound optical lens 31. The position of the apex of the triangular recess is set to be the top line 31CA that matches the shape of the cut-off line.

The compound optical lens 31 has a semi-dome-shaped first reflector surface 31D having a free curved surface and a semi-dome-shaped second reflector surface 31E having a free curved surface. The first reflector surface 31D is formed on the upper side (upper side in the vertical direction) of the incidence surface 31B side of the top line 31CA of the shade part 31C, and reflects, toward the emission surface 31A, a light beam that forms a first diffused-light distribution pattern of the low-beam light distribution pattern. The second reflector surface 31E is formed on the lower side (lower side in the vertical direction) of the incidence surface 31B side of the top line 31CA and reflects, toward the emission surface 31A, a light beam that forms a condensed-light distribution pattern of the low-beam light distribution pattern. Similar to above, the width of the first reflector surface 31D is larger than the width of the second reflector surface 31E in the vehicle width direction at the position where the first reflector surface 31D and the second reflector surface 31E are adjacent to each other.

Since the shade part 31C is formed so as to form a substantially triangular recess in the inner side of the compound optical lens 31, the shade part 31C has a rearward tilting surface 31CB that tilts rearward from the top line 31CA. When a portion of the light reflected by the first reflector surface 31D, a portion of the light reflected by the second reflector surface 31E, and a portion of the direct light from the light source 22 are reflected by the rearward tilting surface 31CB, a portion of the reflected light is reflected by the surface on the front side above the top line 31CA and is emitted from the emission surface 31A toward the front side.

Such light is not planned to be subjected to light distribution control by the emission surface 31A, and thus may be harmful light that is emitted into the lamp chamber and/or the vicinity of the vehicle.

Therefore, in the present embodiment, as illustrated in FIG. 5, the compound optical lens 31 includes a light scatterer 31F formed on the emission surface 31A side of the top line 31CA of the shade part 31C in a section that reflects, toward the emission surface 31A, reflected light that is not planned to be subjected to light distribution control by the emission surface 31A.

Specifically, the light scatterer 31F is formed in a section of the compound optical lens 31 directly irradiated by the light reflected by the rearward tilting surface 31CB. In this way, as illustrated in FIG. 5, light is scattered, and most of the scattered light becomes a light beam L4 emitted from the light scatterer 31F and is shielded and prevented from leaking outside by the cover 40 (see FIG. 2).

A portion of the light scattered by the light scatterer 31F becomes a light beam L5 radiated from the emission surface 31A toward the front side. However, since the intensity of the light beam L5 is significantly reduced, no harm is caused even when the light chamber and/or the vicinity of the vehicle are irradiated with the light beam L5.

The light scatterer 31F is composed of fine asperities (for example, prisms) formed on the surface of the compound optical lens 31. However, the structure is not limited to this as long as light can be efficiently scattered. Another light scatterer may be disposed on the rearward tilting surface 31CB. In this way, the intensity of light that may be radiated to the lamp chamber and/or the vicinity of the vehicle can be further reduced.

In the first embodiment, the case where the compound optical lens 31 mainly controls the formation of the low-beam light distribution pattern has been described. Alternatively, an overhead light distribution may be formed in addition to the low-beam light distribution pattern. The configuration for forming an overhead distribution light will be described below.

As described above, since the shade part 31C is formed so as to form a substantially triangular recess on the inner side of the compound optical lens 31, the shade part 31C has a forward tilting surface 31CC that tilts forward from the top line 31CA.

Since the forward tilting surface 31CC can be used to reflect light obliquely upward, in the present embodiment, a reflective surface 31G is formed on the compound optical lens 31. The reflective surface 31G reflects a portion of the direct light from the light source 22 toward at least a portion of the forward tilting surface 31CC. A light beam L6 reflected by the reflective surface 31G and further reflected by the forward tilting surface 31CC is emitted from the emission surface 31A as overhead distribution light.

Figure 6:
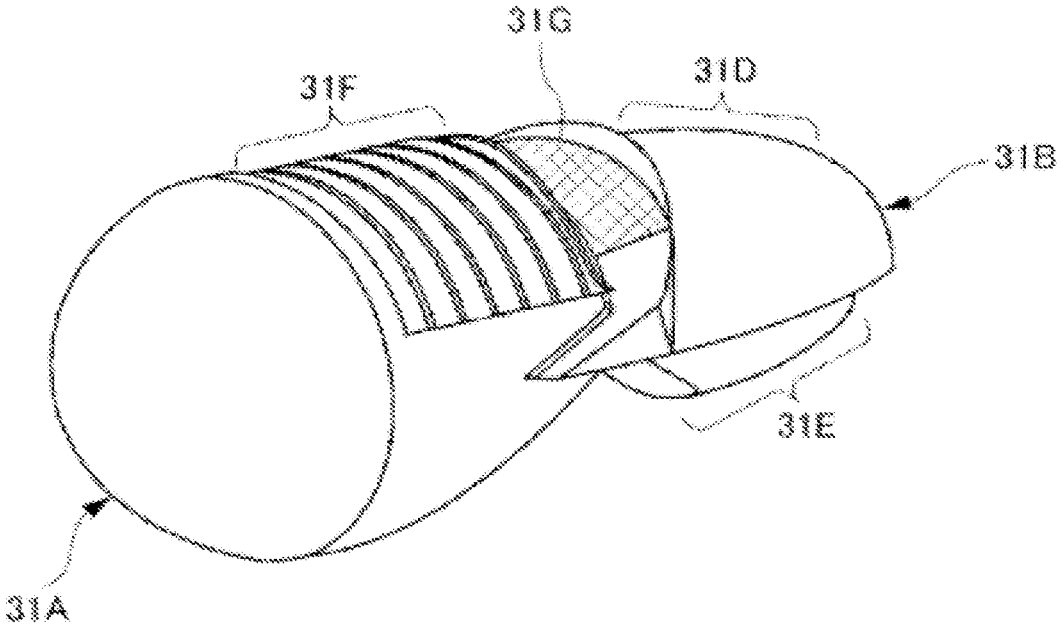
FIG. 6 is a perspective view of the compound optical lens of the second embodiment with the side of an emission surface being visible.

Specifically, as illustrated in FIGS. 5 and 6, the reflective surface 31G is formed between the first reflector surface 31D and the light scatterer 31F on the upper side of the compound optical lens 31, and reflects a portion of the direct light from the light source 22 toward at least a section of the forward tilting surface 31CC.

Figure 7:
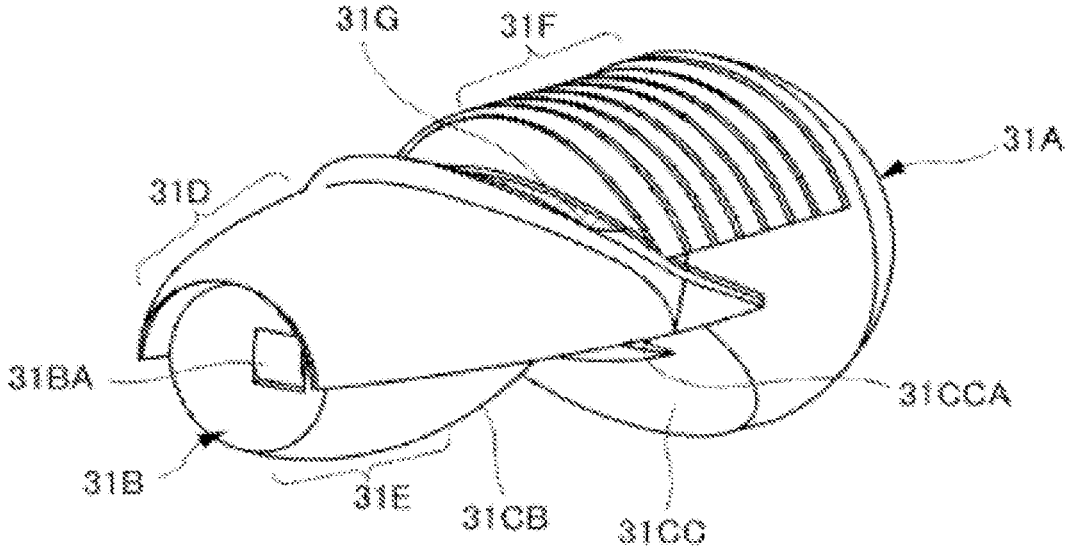
FIG. 7 is a perspective view of the compound optical lens of the second embodiment with the side of an incidence surface being visible.

Note that, in the present embodiment, as illustrated in FIGS. 5 and 7, a reflection angle adjuster 31CCA for adjusting the reflection angle toward the emission surface 31A is disposed in a section of the forward tilting surface 31CC irradiated with the light reflected by the reflective surface 31G.

However, it is not an essential requirement that the forward tilting surface 31CC be provided with the reflection angle adjuster 31CCA. Alternatively, the tilt state of the entire forward tilting surface 31CC may be set so that the light reflected by the reflective surface 31G is reflected toward the emission surface 31A at a reflection angle suitable for overhead light distribution.

Since the first reflector surface 31D, the second reflector surface 31E, the forward tilting surface 31CC (or may be only the reflection angle adjuster 31CCA), and the reflective surface 31G are required to have a function of reflecting light, they may be colored with white or silver to increase the light reflectance.

According to the present embodiment, a satisfactory lamp unit 1 can be provided that can suppress harmful light, which may be generated due to the user of the compound optical lens 31, emitted to the lamp chamber and/or the vicinity of the vehicle, and can form overhead distribution light by the compound optical lens 31, which forms a low-beam light distribution pattern.

Third Embodiment

A vehicle lamp of a third embodiment will now be described with reference to FIGS. 8 to 14. The overall configuration of the lamp unit 1 is also the same in the third embodiment, and the only difference from the first and second embodiments is the compound optical lens 31. Therefore, the main differences will be described below, and description of the same points may be omitted.

In the conventional technique, a vehicle lamp including a compound optical lens in which an incidence surface, an emission surface, and a shade part are integrally molded is known (for example, French Patent Publication No. 3010772).

However, in the conventional technique as described above, since the compound optical lens collects the light incident to the incidence surface at the focal point of the emission surface, it is difficult to form a light distribution pattern having a spread or the like.

Therefore, it is an object of the vehicle lamp of the third embodiment to facilitate the formation of a light distribution pattern having a spread.

The vehicle lamp of the third embodiment includes a light source and a compound optical lens. The compound optical lens includes an incidence surface on which light is incident; an emission surface that emits the light from the incidence surface toward the front side; a shade part formed between the incidence surface and the emission surface; a first reflector surface formed on the upper side of the incidence surface side and reflects the light forming a first light distribution pattern toward the emission surface; and a second reflector surface formed on the lower side of the incidence surface side and reflects the light forming a condensed-light distribution pattern toward the emission surface. The incidence surface on the vertical cross-section passing through the optical axis is formed such that the lower side of the incidence surface positioned below the light source is closer to the light source than the upper side of the incidence surface positioned above the light source.

According to the vehicle lamp of the third embodiment, it is also possible to facilitate the formation of a light distribution pattern having a spread.

The compound optical lens 31 will now be described in detail with reference to FIGS. 8 to 14. Here, the overall features of the compound optical lens 31 will be described with reference to FIGS. 8 to 10, and then the features of a portion of the compound optical lens 31 (the lower region of the incidence surface 31B) will be described in more detail with reference to FIGS. 12 to 14.

Figure 8:
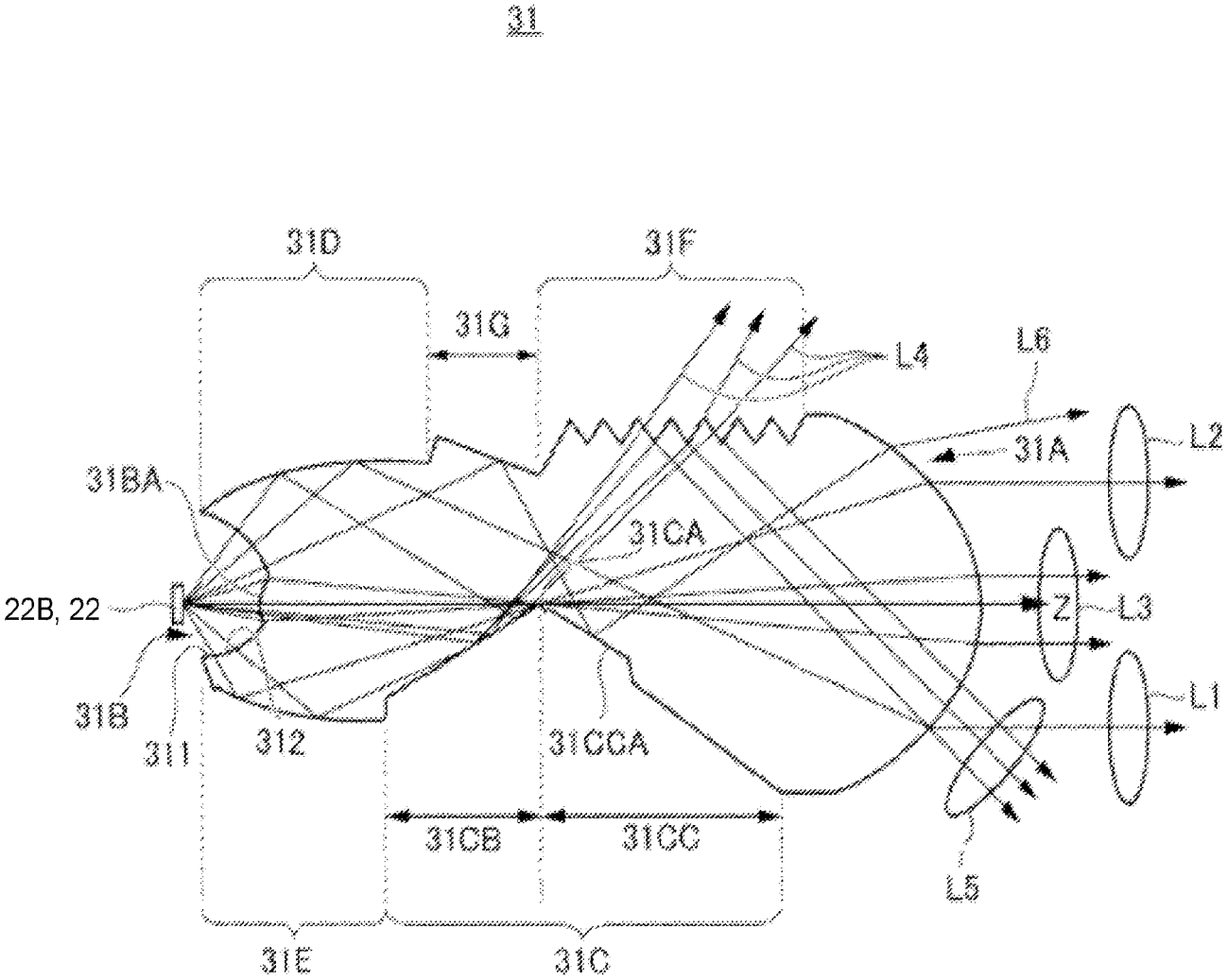
FIG. 8 is a cross-sectional view of a compound optical lens of a third embodiment.
Figure 9:
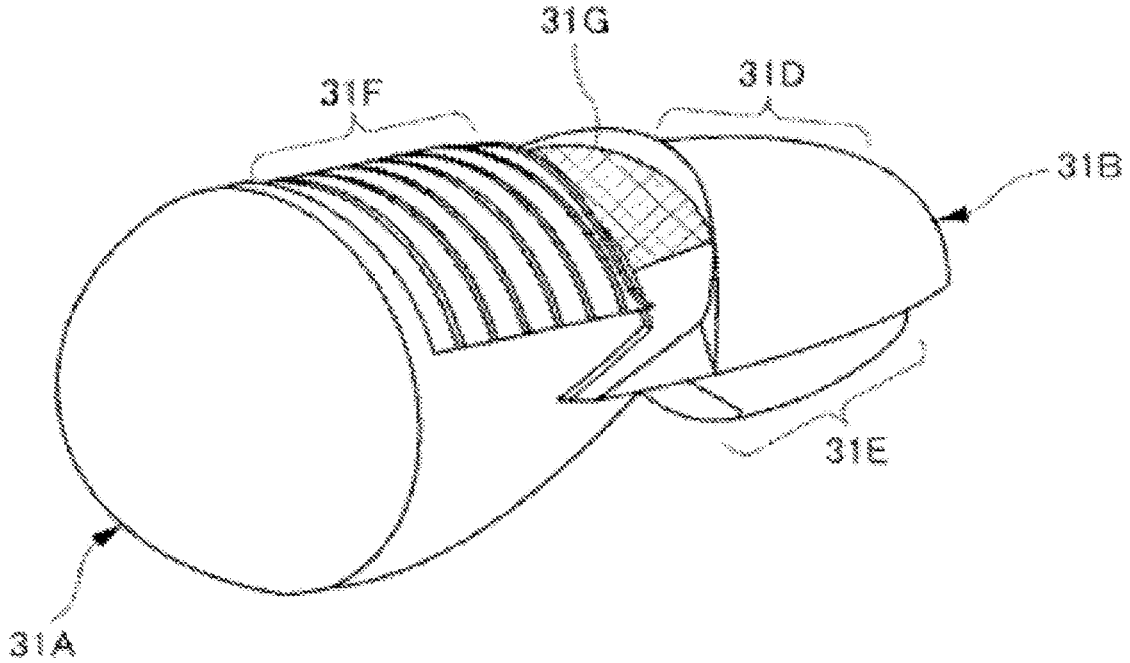
FIG. 9 is a perspective view of the compound optical lens of the third embodiment with the side of an emission surface being visible.
Figure 10:
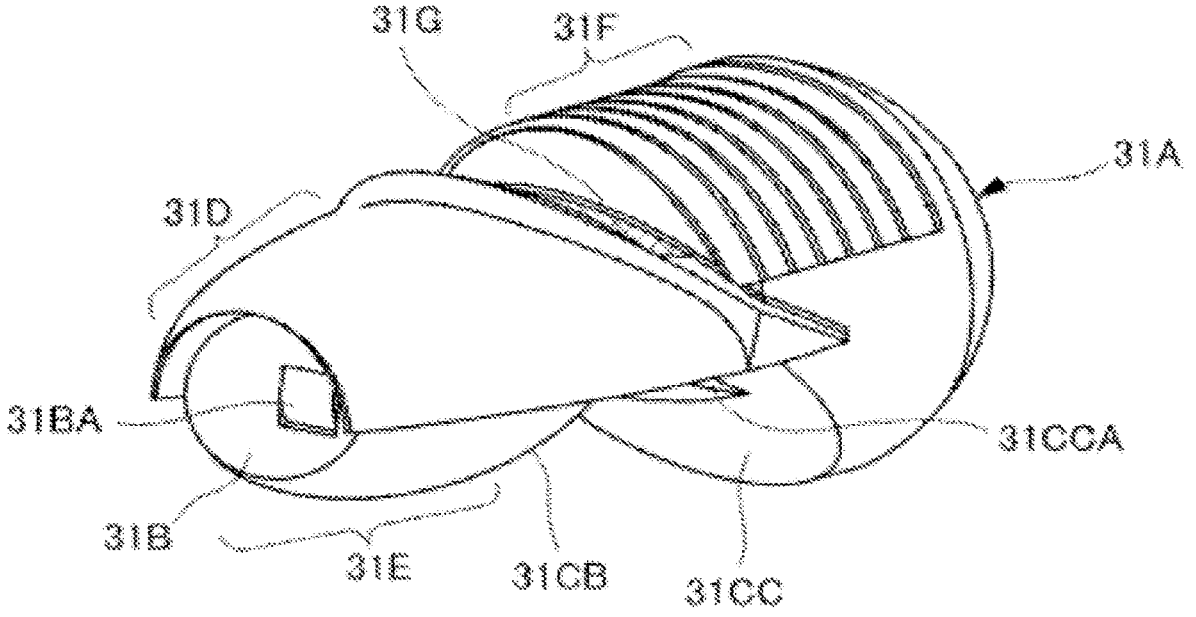
FIG. 10 is a perspective view of the compound optical lens of the third embodiment with the side of an incidence surface being visible.

FIG. 8 is a cross-sectional view of the compound optical lens 31 of the present embodiment and is a cross-sectional view from the side surface taken along the lens optical axis Z in the vertical direction. Note that FIG. 8 also schematically illustrates the light emitting region 22B of the light source 22. FIG. 9 is a perspective view of the compound optical lens 31 in which that the emission surface 31A side of the present embodiment is visible. FIG. 10 is a perspective view of the compound optical lens 31 in which the incidence surface 31B side of the present embodiment is visible.

As illustrated in FIG. 8, the compound optical lens 31 of the present embodiment is an integrally molded lens having an incidence surface 31B, an emission surface 31A, and a shade part 31C. The incidence surface 31B receives light from the light source 22. The emission surface 31A emits the light from the incidence surface 31B toward the front side. The shade part 31C is formed between the incidence surface 31B and the emission surface 31A.

The shade part 31C is formed so as to form a substantially triangular recess on the inner side of the compound optical lens 31 from the lower side in the vertical direction at a position between the incidence surface 31B and the emission surface 31A of the compound optical lens 31. The position of the apex of the triangular recess is set to be the top line 31CA that matches the shape of the cut-off line.

The compound optical lens 31 has a semi-dome-shaped first reflector surface 31D having a free curved surface and a semi-dome-shaped second reflector surface 31E (total reflection surface) having a free curved surface. The first reflector surface 31D is formed on the upper side (upper side in the vertical direction) of the incidence surface 31B side of the top line 31CA of the shade part 31C, and reflects, toward the emission surface 31A, a light beam L1 that forms a first light distribution pattern of the low-beam light distribution pattern incident from the incidence surface 31B. The second reflector surface 31E is formed on the lower side (lower side in the vertical direction) of the incidence surface 31B side of the top line 31CA and reflects, toward the emission surface 31A, a light beam L2 that forms a condensed-light distribution pattern of the low-beam light distribution pattern incident from the incidence surface 31B.

In the present embodiment, the incidence surface 31B is a concave surface of which the overall shape is recessed toward the inner side of the compound optical lens 31. The incidence surface 31B has a convex surface 31BA that protrudes outward from the compound optical lens 31 and receives a light beam L3 forming a second light distribution pattern of the low-beam light distribution pattern in the central area.

Note that, in the present embodiment, the second light distribution pattern is a medium-diffused-light distribution pattern of the low-beam light distribution pattern that is smaller than the first diffused-light distribution pattern of the low-beam light distribution pattern, and therefore hereinafter may be referred to as the second diffused-light distribution pattern.

As illustrated in FIG. 10, the convex surface 31BA has a substantially rectangular outer shape (square shape) and is formed so that the front focal point is located on the top line 31CA or in the vicinity of the top line 31CA, as illustrated in FIG. 8.

Since the light source 22 is positioned behind the convex surface 31BA so that the center of the convex surface 31BA and the light emission center of the light source 22 substantially coincide with each other when viewed in the vehicle width direction and the vertical direction, the light received by the convex surface 31BA is gradually condensed toward the top line 31CA and then gradually spreads from the front focal point toward the emission surface 31A, without great refraction, so as to form a satisfactory medium-diffused-light distribution pattern.

Note that, to be more precise, the convex surface 31BA is designed to collect light in the vertical direction, but is designed to diffuse or spread in the horizontal direction.

Therefore, in the present embodiment, as illustrated in FIG. 8, the compound optical lens 31 includes a light scatterer 31F formed on the emission surface 31A side of the top line 31CA of the shade part 31C in a section that reflects, toward the emission surface 31A, reflected light that is not planned to be subjected to light distribution control by the emission surface 31A.

Specifically, the light scatterer 31F is formed in a section of the compound optical lens 31 directly irradiated by the light reflected by the rearward tilting surface 31CB. In this way, as illustrated in FIG. 8, light is scattered, and most of the scattered light becomes a light beam L4 emitted from the light scatterer 31F and is shielded and prevented from leaking outside by the cover 40 (see FIG. 2).

A portion of the light scattered by the light scatterer 31F becomes a light beam L5 radiated from the emission surface 31A toward the front side. However, since the intensity of the light beam L5 is significantly reduced, no harm is caused even when the light chamber and/or the vicinity of the vehicle are irradiated with the light beam L5.

The light scatterer 31F is composed of fine asperities (for example, prisms) formed on the surface of the compound optical lens 31. However, the structure is not limited to this as long as light can be efficiently scattered.

Another light scatterer may be disposed on the rearward tilting surface 31CB. In this way, the intensity of light that may be radiated to the lamp chamber and/or the vicinity of the vehicle can be further reduced.

Figure 11:
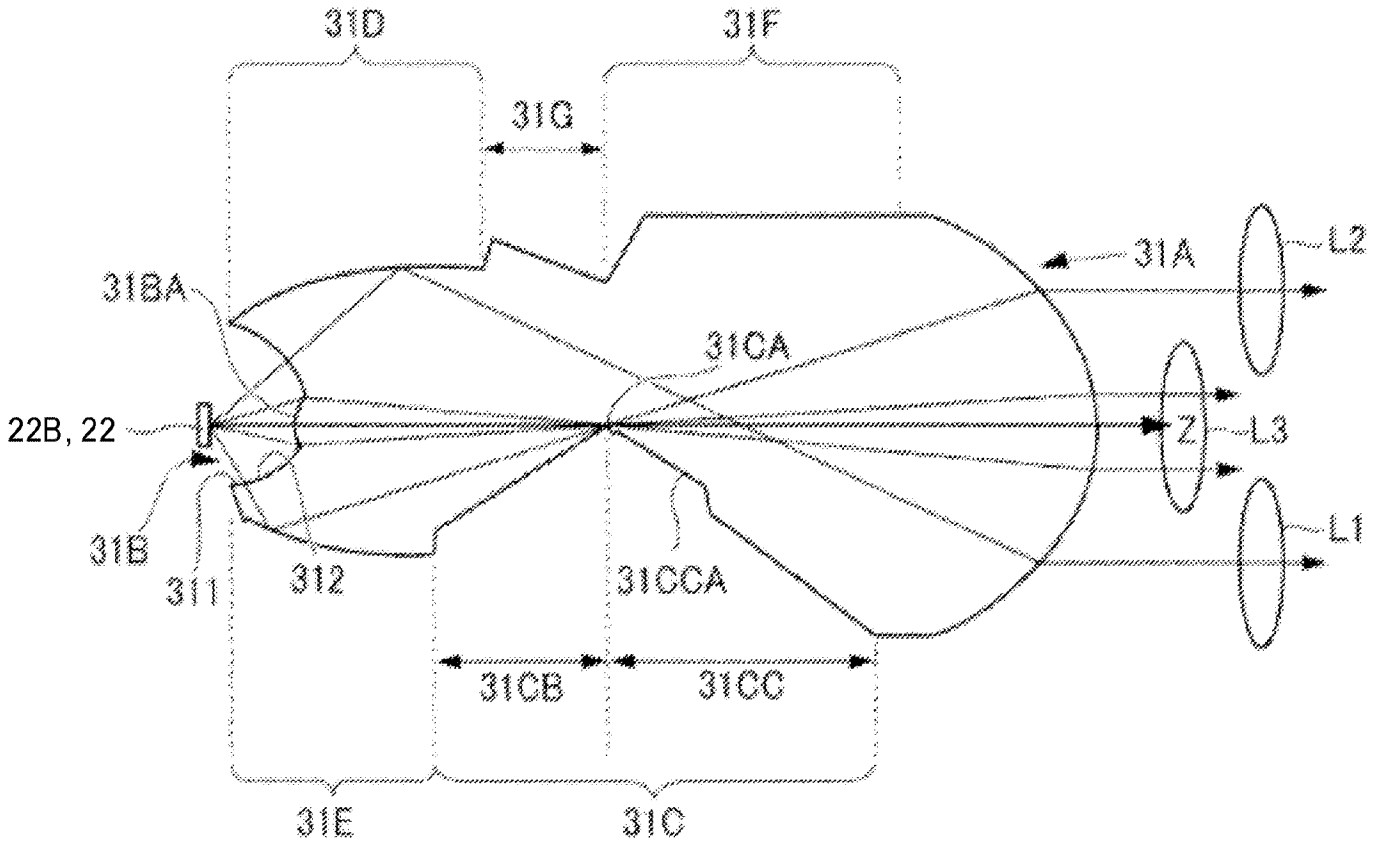
FIG. 11 is a cross-sectional view of a compound optical lens according to a modification.

In the modified example, as illustrated in FIG. 11, the light scatterer 31F may be omitted.

In the present embodiment, the case where the compound optical lens 31 mainly controls the formation of the low-beam light distribution pattern has been described. Alternatively, an overhead light distribution may be formed in addition to the low-beam light distribution pattern. The configuration for forming an overhead distribution light will be described below.

As described above, since the shade part 31C is formed so as to form a substantially triangular recess on the inner side of the compound optical lens 31, the shade part 31C has a forward tilting surface 31CC that tilts forward from the top line 31CA.

Since the forward tilting surface 31CC can be used to reflect light obliquely upward, in the present embodiment, a reflective surface 31G is formed on the compound optical lens 31. The reflective surface 31G reflects a portion of the direct light from the light source 22 toward at least a portion of the forward tilting surface 31CC. A light beam L6 reflected by the reflective surface 31G and further reflected by the forward tilting surface 31CC is emitted from the emission surface 31A as overhead distribution light.

Specifically, as illustrated in FIGS. 8 and 9, the reflective surface 31G is formed between the first reflector surface 31D and the light scatterer 31F on the upper side of the compound optical lens 31, and reflects a portion of the direct light from the light source 22 toward at least a section of the forward tilting surface 31CC.

Note that, in the present embodiment, as illustrated in FIGS. 8 and 10, a reflection angle adjuster 31CCA for adjusting the reflection angle toward the emission surface 31A is disposed in a section of the forward tilting surface 31CC irradiated with the light reflected by the reflective surface 31G.

The features of a portion of the compound optical lens 31 (the lower region of the incidence surface 31B) will be described in more detail with reference to FIGS. 12 to 14.

Figure 12:
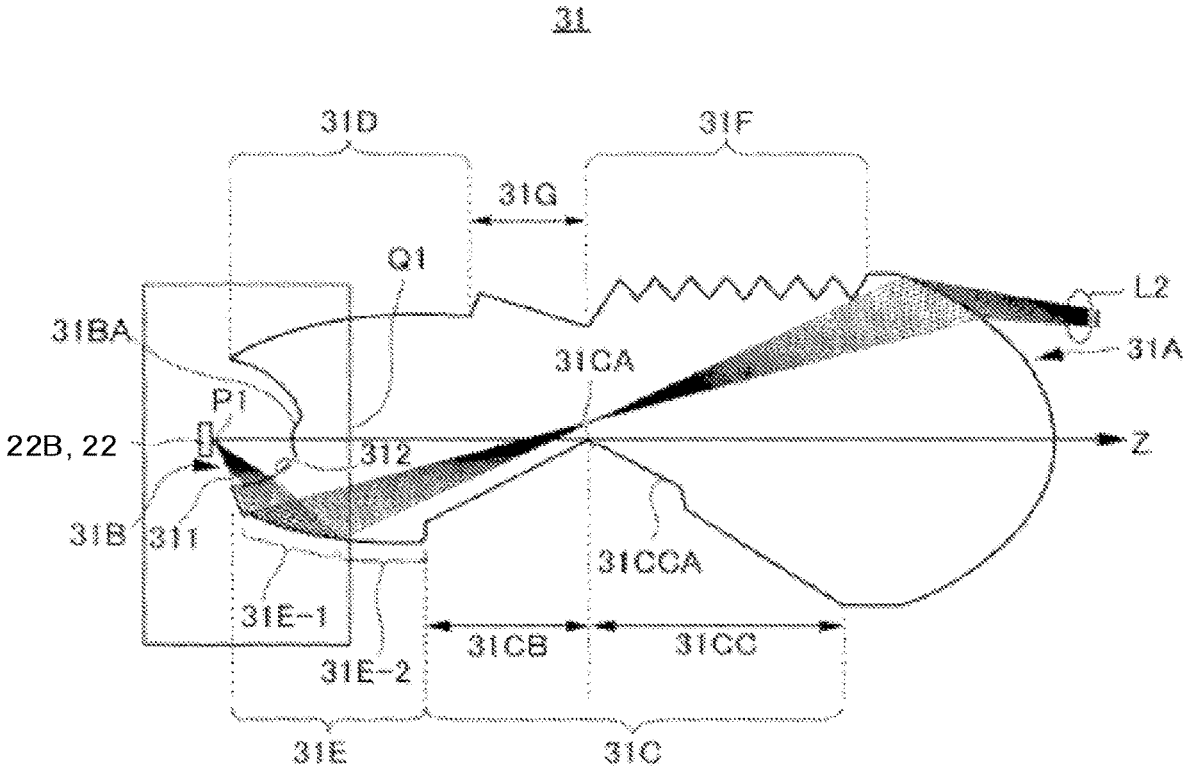
FIG. 12 is a cross-sectional view of a compound optical lens for describing an optical path of light forming a condensed-light distribution pattern.

FIG. 12 is a cross-sectional view of the compound optical lens 31 and is a cross-sectional view from the side surface taken along the lens optical axis Z in the vertical direction. FIG. 12 is the same cross-sectional view as that of FIG. 8, but is an explanatory diagram illustrating in detail the optical path of the light beam L2 (see FIG. 8) forming the condensed-light distribution pattern of the low-beam light distribution pattern. FIG. 13 is an enlarged view of the Q1 portion in FIG. 12. FIG. 14 is an explanatory view (cross-sectional view) of the case of a comparative example. In FIGS. 12 to 14, the position of the light source 22 (the position of the light emission center) is denoted by P1.

As described above, the lower region of the incidence surface 31B is a region on which the light reflected by the second reflector surface 31E is incident. As described above, the light reflected by the second reflector surface 31E includes the light beam L4 emitted from the light scatterer 31F and the light beam L2 forming the condensed-light distribution pattern of the low-beam light distribution pattern. Note that, as described above, the light scatterer 31F may be omitted. In such a modification (see FIG. 11), the light beam L4 is light that reaches a section corresponding to the light scatterer 31F (however, unlike the light scatterer 31F, the surface of this section is not provided with fine asperities).

As illustrated in FIG. 12, on the second reflector surface 31E, a region 31E-1 that reflects the light beam L2 is positioned closer to the light source 22 than a region 31E-2 that reflects the light beam L4, in the direction of the lens optical axis Z.

Figure 13:
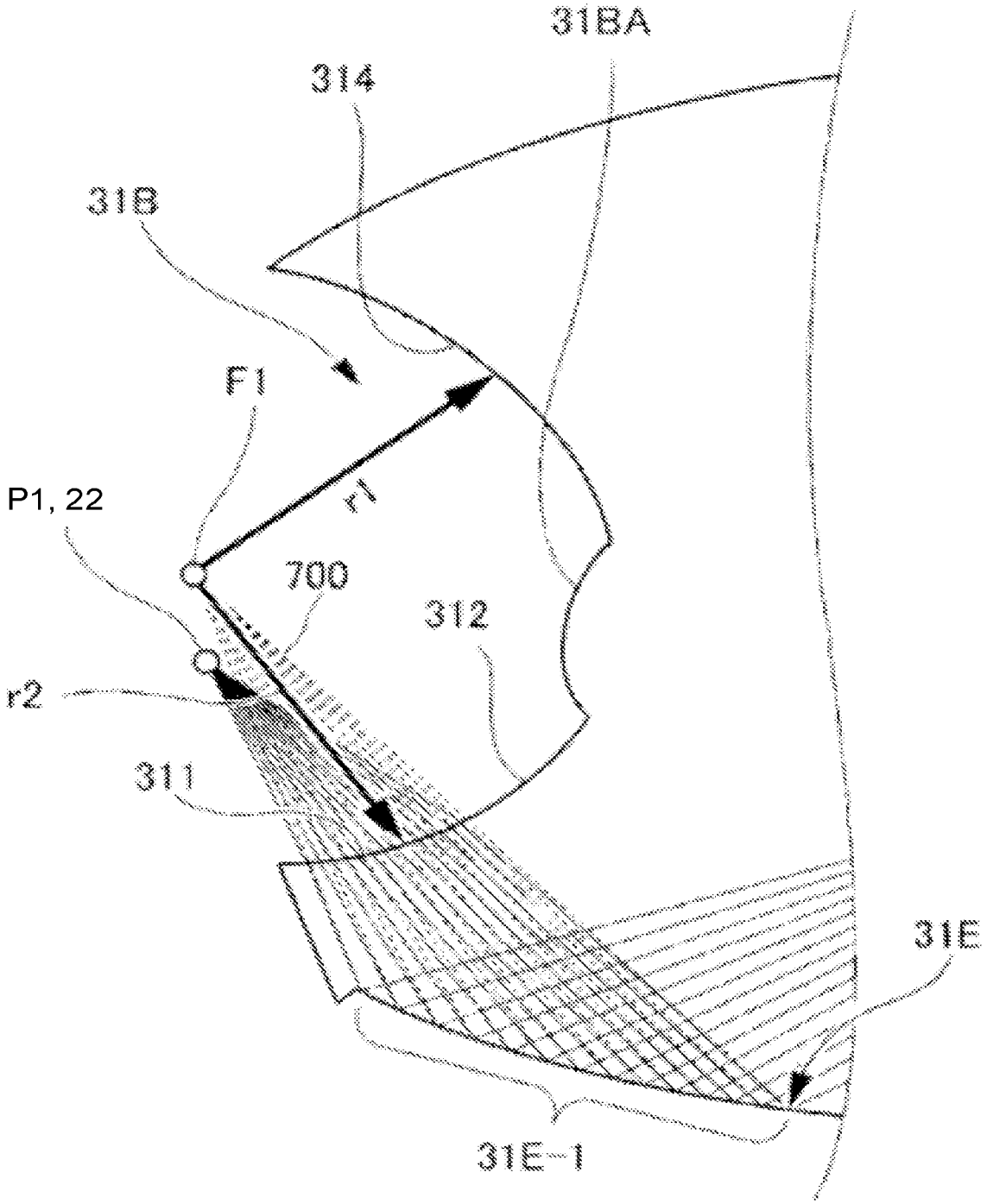
FIG. 13 is an enlarged view of the Q1 portion in FIG. 12.

In the present embodiment, the region below the light source 22 (or the light emitting region 22B) on the incidence surface 31B (hereinafter, referred to as "lower incidence surface 311") is formed such that light incident on the lower incidence surface 311 from the light emitting center is refracted, as illustrated in FIGS. 12 and 13. That is, the light beam L2 is refracted at the incidence surface 31B and then reflected by the second reflector surface 31E.

Specifically, as illustrated in FIG. 13, the lower incidence surface 311 is formed such that each light beam of the light refracted at the lower incidence surface 311 is focused at a point F1 (hereinafter, referred to as "virtual focal point F1") above the light source 22 when the light is traced in a direction opposite to the traveling direction of the light. That is, in FIG. 13, each light beam of the light refracted is indicated by the dotted lines 700 when the light refracted at the lower incidence surface 311 is traced in a direction opposite to the traveling direction of the light. The dotted lines 700 intersect at the virtual focal point F1.

In the present embodiment, the incidence surface 31B is formed such that the virtual focal point F1 is positioned above the light source 22 (see position P1) as illustrated in FIG. 13. As a result, it becomes easy to reflect the light refracted by the lower incidence surface 311 to the region of the second reflector surface 31E near the light source 22 in the direction of the lens optical axis Z. That is, the region on the second reflector surface 31E near the light source 22 in the direction of the lens optical axis Z can be efficiently used as the region 31E-1 where the light beam L2 is reflected.

The position of the virtual focal point F1 is determined in accordance with the lower incidence surface 311. When the lower incidence surface 311 is formed such that the virtual focal point F1 is positioned above the light source (see position P1), the lower incidence surface 311 is disposed closer to the light source 22 than a region 314 (see FIG. 13) above the convex surface 31BA of the incidence surface 31B. That is, when the region 314 is shaped like a sphere having a radius r1 centered on the light source 22 (see position P1), the distance r2 from the light source 22 (see position P1) to an arbitrary point in the lower incidence surface 311 is r1 or smaller.

Figure 14:
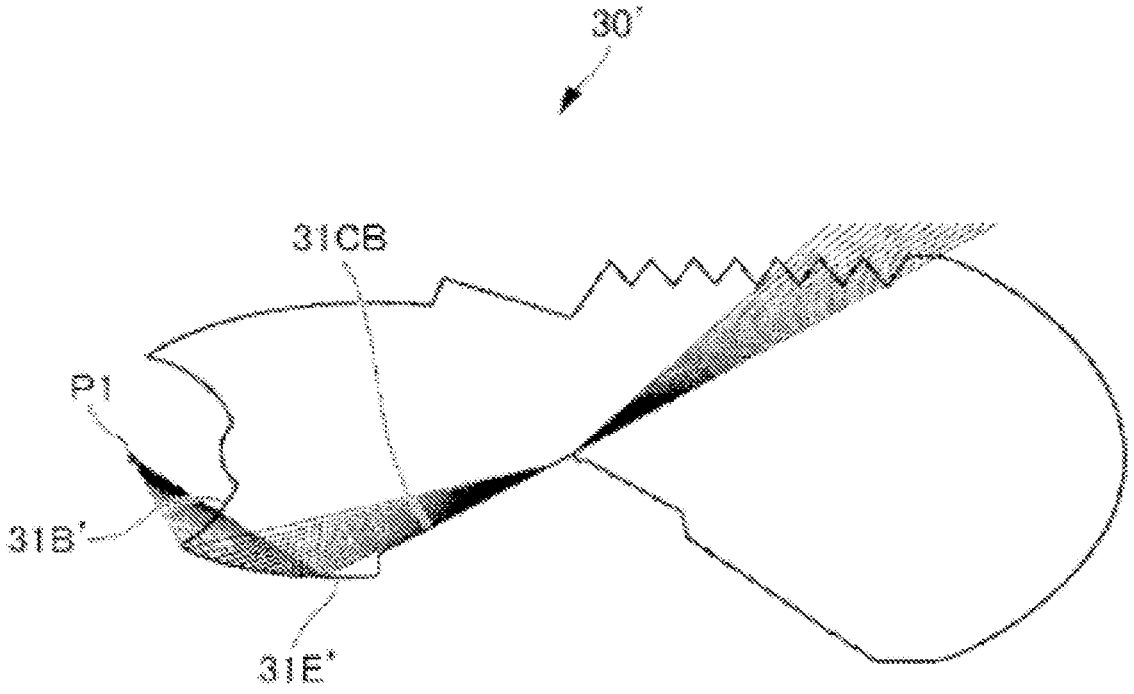
FIG. 14 is an explanatory view (cross-sectional view) of the case of a comparative example.

Here, with reference to an optical control member 30' according to the comparative example illustrated in FIG. 14, the optical control member 30' differs from the optical control member 30 according to the present embodiment in that the incidence surface 31B is replaced with an incidence surface 31B'. In the comparative example, the incidence surface 31B' has a shape of a sphere (spherical surface) centered on the light source (see position P1) except for the convex surface 31BA. In such the case, as illustrated in FIG. 14, the light from the region below the incidence surface 31B' and reflected by the region of a second reflector surface 31E' near the light source 22 in the direction of the lens optical axis Z is reflected by the rearward tilting surface 31CB and travels toward the light scatterer 31F. That is, the light does not readily reach the emission surface 31A.

On the other hand, as described above in the present embodiment, the region of the second reflector surface 31E near the light source 22 in the direction of the lens optical axis Z is the region 31E-1 that reflects the light beam L2, i.e., the region 31E-1 that reflects the light that enters the emission surface 31A.

In this way, it is possible to reduce the light directed to the light scatterer 31F as in the comparative example illustrated in FIG. 14 and increase the light entering the emission surface 31A. In this way, in the present embodiment, among the light beams from the light source 22, the light beams reflected in the region of the second reflector surface 31E near the light source 22 in the direction of the lens optical axis Z can also be used as a light distribution pattern emitted from the emission surface 31A. That is, the utilization efficiency of the light increases.

According to the present embodiment, the second reflector surface 31E can be designed as a reflective surface (free curved surface) having a focal point at the virtual focal point F1, and thus the structure can be easily designed.

In the present embodiment, the second reflector surface 31E includes the region 31E-1 that reflects the light beam L2 and the region 31E-2 that reflects the light beam L4. According to the modified example, the second reflector surface 31E may include only the region 31E-1 that reflects the light beam L2.

Although the specific embodiments have been described above, the present invention is not limited to the embodiments, and modifications and improvements are also included in the technical scope of the invention.

For example, although the case where the compound optical lens 31 forms a low-beam light distribution pattern has been described above, the compound optical lens may be a compound optical lens that forms a high-beam light distribution pattern without the shade part 31C. Since it is possible to form a diffused distribution light pattern and a condensed-light distribution pattern of the high-beam light distribution pattern with one compound optical lens, the size of the vehicle lamp can be reduced.

The shade function may be enhanced by applying aluminum vapor deposition, coloring, or the like to the surface of the shade part 31C.

In the above embodiment, the entire lower incidence surface 311 is formed such that the light beams of the light refracted by the lower incidence surface 311 focuses at the virtual focal point F1 when the light is traced in a direction opposite to the traveling direction. However, the lower incidence surface 311 is not limited thereto. For example, an upper portion of a region 312 of the lower incidence surface 311 may have a different design.

As described above, the present invention is not limited to the embodiments, and this will be apparent to those skilled in the art from the description of the claims.

DESCRIPTION OF REFERENCE NUMERALS

1 lamp unit
10 heatsink
11 base part
11A positioning pin
11B screw engagement hole
12 heat radiating fin
20 light source device
21 heat transfer member
22 light source
22A substrate
22B light emitting region
23 connecting part
23A opening
23B connector connecting portion
24A positioning hole
24B screw hole
30 optical control member
31 compound optical lens
31A emission surface
31B incidence surface
31BA convex surface
31C shade part
31CA top line
31CB rearward tilting surface
31CC forward tilting surface
31CCA reflection angle adjustment unit
31D first reflector surface
31E second reflector surface
31F light scatterer
31G reflective surface
32 fixing part
32A leg portion
32B base portion
32BA positioning hole
32BB screw hole
40 cover
41 covering part
41A notch
42 flange part
42A positioning hole
42B screw hole
L1, L2, L3, L4, L5, L6 light beam
N screw
Z lens optical axis
101L, 101R headlight for vehicles
102 vehicle

The invention claimed is:

1. A vehicle lamp comprising:

a light source, and a compound optical lens that emits light of the light source toward a front side of the vehicle lamp, wherein, the compound optical lens is an integrally molded lens having an incidence surface, an emission surface, and a shade part, the incidence surface receiving light, the emission surface emitting the light from the incidence surface toward the front side, the shade part being disposed between the incidence surface and the emission surface, the compound optical lens includes:

a first reflector surface that is disposed above a top line of the shade part on an upper side of the incidence surface and reflects a light forming a first light distribution pattern toward the emission surface; and a second reflector surface that is disposed below the top line on a lower side of the incidence surface side and reflects a light forming a condensed-light distribution pattern toward the emission surface, the width of the first reflector surface is larger in a width of a vehicle width direction at a position where the first reflector surface and the second reflector surface are adjacent to each other.

2. The vehicle lamp according to claim 1, wherein the incidence surface is a concave surface of which the overall shape is recessed toward the inner side of the compound optical lens, and the incidence surface has a convex surface that protrudes outward from the compound optical lens and receives a light forming a second light distribution pattern in the central area, the second light distribution pattern being smaller than the first light distribution pattern.

3. The vehicle lamp according to claim 2, wherein the emission surface has a shape that causes a portion of the light forming the first light distribution pattern to be emitted above a cutoff line of the condensed-light distribution pattern and the second light distribution pattern.

4. The vehicle lamp according to claim 2, wherein the convex surface has a rectangular outer shape when viewed from the incidence surface side.

5. The vehicle lamp according to claim 1, wherein the shade part has a forward tilting surface that tilts forward from the top line, the compound optical lens has a reflective surface that reflects a portion of direct light from the light source toward at least a portion of the forward tilting surface, and the light reflected by the reflective surface and by the forward tilting surface is emitted from the emission surface as overhead distribution light.

6. The vehicle lamp according to claim 1, wherein the incidence surface has a convex surface portion protruding outward from the compound optical lens and receives a light forming a second light distribution pattern in a central area, the second light distribution pattern being smaller than the first light distribution pattern.

7. The vehicle lamp according to claim 6, wherein the convex surface portion has a rectangular outer shape when viewed from the incidence surface side.

8. A vehicle lamp comprising:

a light source, and a compound optical lens, wherein, the compound optical lens includes:

an incidence surface receiving light;

an emission surface emitting the light from the incidence surface toward a front side of the vehicle lamp;

a shade part disposed between the incidence surface and the emission surface;

a first reflector surface disposed above the incidence surface and reflecting light to form a first light distribution pattern toward the emission surface; and a second reflector surface disposed below the incidence surface and reflecting light to form a condensed-light distribution pattern toward the emission surface, the incidence surface is disposed in such a manner that a lower incidence surface positioned below the light source is closer to the light source than an upper incidence surface positioned above the light source in a vertical cross-section passing through an optical axis.

9. The vehicle lamp according to claim 8, wherein the second reflector surface is disposed in such a manner that the focal point of the second reflector surface is positioned above the light source.

10. The vehicle lamp according to claim 8, wherein the lower incidence surface is disposed in such a manner that each light beam of the light refracted by the lower incidence surface is focused at a point above the light source when the light is traced in a direction opposite to a traveling direction of the light.

11. The vehicle lamp according to claim 8, wherein the incidence surface is a concave surface of which the overall shape is recessed toward the inner side of the compound optical lens, and the incidence surface has a convex surface in a central area above the lower incidence surface, the convex surface protruding outward from the compound optical lens and receiving light forming a second light distribution pattern, the second light distribution pattern being smaller than the first light distribution pattern.

* * * * *